US007562869B2

(12) United States Patent
Mao et al.

(10) Patent No.: US 7,562,869 B2
(45) Date of Patent: Jul. 21, 2009

(54) FIXED SIDE EDGE REGISTRATION SYSTEM

(75) Inventors: Yanmin Mao, Brampton (CA); Hongfeng Xu, Brampton (CA)

(73) Assignee: Xerox Corporation, Norwalk, CT (US)

( * ) Notice: Subject to any disclaimer, the term of this patent is extended or adjusted under 35 U.S.C. 154(b) by 319 days.

(21) Appl. No.: 11/533,015

(22) Filed: Sep. 19, 2006

(65) Prior Publication Data

US 2008/0067735 A1 Mar. 20, 2008

(51) Int. Cl.
*B65H 31/36* (2006.01)

(52) U.S. Cl. ..... 271/221; 271/220

(58) Field of Classification Search ..... 271/220, 271/221, 223, 224; 270/58.12, 58.17, 58.21
See application file for complete search history.

(56) References Cited

U.S. PATENT DOCUMENTS

| | | | | |
|---|---|---|---|---|
| 4,147,342 | A | 4/1979 | Naramore | |
| 4,844,440 | A | 7/1989 | Gray | |
| 5,014,977 | A | 5/1991 | Moore et al. | |
| 5,273,274 | A | 12/1993 | Thomason et al. | |
| 5,473,420 | A | 12/1995 | Rizzolo et al. | |
| 5,501,442 | A | 3/1996 | Mandel | |
| 5,510,877 | A | 4/1996 | deJong et al. | |
| 5,516,092 | A * | 5/1996 | Pollich | 271/221 |
| 5,639,078 | A * | 6/1997 | Mandel et al. | 270/58.12 |
| 5,642,876 | A * | 7/1997 | Ferrara et al. | 270/58.01 |
| 5,791,644 | A | 8/1998 | Regimbal et al. | |
| 5,890,713 | A * | 4/1999 | Hofmann et al. | 271/221 |
| 6,003,862 | A | 12/1999 | Russell et al. | |
| 6,126,163 | A * | 10/2000 | Katsuta et al. | 271/223 |
| 6,257,571 | B1 * | 7/2001 | Kniss et al. | 271/181 |
| 6,533,268 | B2 | 3/2003 | Williams et al. | |
| 6,819,906 | B1 | 11/2004 | Herrmann et al. | |
| 6,908,079 | B2 | 6/2005 | Milillo et al. | |
| 7,043,192 | B2 | 5/2006 | Terao et al. | |
| 7,300,053 | B2 * | 11/2007 | Asano | 271/224 |
| 7,389,980 | B2 * | 6/2008 | Kushida | 270/58.12 |
| 2002/0060415 | A1 * | 5/2002 | Kaneko | 271/221 |
| 2004/0188911 | A1 | 9/2004 | McNamara et al. | |
| 2005/0263958 | A1 | 12/2005 | Knierim et al. | |
| 2006/0049574 | A1 | 3/2006 | Matsumoto | |

* cited by examiner

*Primary Examiner*—Kaitlin S Joerger
(74) *Attorney, Agent, or Firm*—Gibb I.P. Law Firm, LLC

(57) ABSTRACT

Disclosed are embodiments of an edge registration system and method. The embodiments employ a compiling tray with a fixed side edge. A movable backstop stops each sheet as it is fed into the tray. A tamper tamps each sheet against the fixed side edge. The registered stack is then aligned with one or more finishing mechanisms by a repositioner that laterally repositions the stack and by the movable backstop that repositions the stack between the front and back ends of the tray. Because the fixed side edge covers the entire paper length and because the paper is only tamped a short distance to achieve registration, the system provides greater support for squaring the sheets. Additionally, because the paper is only tamped a short distance to achieve registration and because the backstop is only moved during alignment of the stack with a finishing mechanism, the system is capable of improving productivity.

20 Claims, 6 Drawing Sheets

FIXED SIDE EDGE REGISTRATION SYSTEM

BACKGROUND

1. Field

Embodiments herein generally relate to systems and methods for compiling, registering and positioning a stack of print media sheets.

2. Description of Related Art

A variety of systems and method are conventionally used to compile, register and position a stack of print media sheets following completion of a printing process and prior to being acted upon by a finishing mechanism, such as a booklet maker and/or stapler. Generally, in such systems, each sheet is printed, fed or dropped into a compiling tray until an edge of the sheet reaches a backstop at the back end of the tray. The position of the backstop is typically determined by the length of the sheets being received and compiled. As each sheet is received by the tray, it is moved using side tampers in conjunction with the backstop to both register the side edges of all the sheets in the stack and to laterally reposition the stack along an x-axis to a desired location within the tray. The backstop can further be movable so as to also allow repositioning of the stack along a y-axis towards between the front and back of the tray. Repositioning the stack along both the x-axis and y-axis can be performed, specifically, to align the stack as necessary with one or more finishing mechanisms.

Disclosed are embodiments of a system and method for compiling, registering and repositioning a stack of print media that provides quality registration within a compiling tray despite limited space availability.

SUMMARY

In view of the foregoing, disclosed herein are exemplary embodiments of an edge registration system for print media sheets and, more particularly, for incorporation into a compiling tray of a printing machine between a printing mechanism and one or more finishing mechanisms (e.g., a booklet maker capable of folding and/or stapling operations). Also, disclosed are embodiments of an associated edge registration method.

The embodiments employ a compiling tray with a fixed side edge, opposing side tampers and a backstop that is normal to the fixed side edge and side tampers. The fixed side edge covers the length of the compiling tray and is positioned outside a print media sheet path. Print media sheets are fed into the compiling tray along the path and stopped by the backstop. A side tamper tamps every sheet against the fixed side edge for within stack registration. After the stack is compiled and registered, a repositioner (i.e., an opposing side tamper) extends from behind the fixed side edge and laterally repositions the stack along the x-axis such that it remains "square" to the backstop. Both side tampers can be used during laterally repositioning for better control. Additionally, the backstop can be movable (i.e., can comprise a rear tamper) that can be used adjusted to accommodate different length sheets and to reposition the stack along the y-axis between the front and back of the tray for alignment with one or more finishing mechanism.

More particularly, embodiments of the system comprise a compiling tray (e.g., a vertically or horizontally oriented compiling tray). This tray can comprise a base, a fixed side edge, a tamper opposite and parallel to the fixed side edge, a repositioner opposite and parallel to the tamper and a backstop that is perpendicular to the fixed side edge as well as to the tamper and repositioner.

Specifically, the base can have a front end, a back end, a first side and a second side. The tray can be adapted to receive print media sheets along a registration line on the first side of the base.

The fixed side edge can extend perpendicularly from the base. The fixed side edge can further traverse the first side of the base immediately outside and parallel to the side registration line from the front end to the back end of the base. The length of the fixed side edge can be approximately equal to or greater than the length of the print media sheets. Additionally, the fixed side edge can be segmented such that it comprises at least one first section near the front end and at least one second section near the back end. The first and second sections of the fixed side edge can each comprise, for example, a single plate or plurality of tabs.

The tamper can extend perpendicularly away from the base adjacent to the second side such that it is positioned opposite and parallel to the fixed side edge. The tamper can be adapted to tamp the print media sheets against the fixed side edge immediately after each sheet is received into the tray.

The repositioner (i.e., a second tamper) can extend perpendicularly away from the base adjacent to the first side and can be positioned between the first section and the second section of the fixed side edge directly opposite and parallel to the tamper. The repositioner can be adapted to extend through the fixed side edge (i.e., through the gap between the first and second sections of the fixed side edge) in order to laterally reposition the stack of print media sheets along the x-axis of the base towards the second side of the tray. The repositioner can further be adapted to work alone or, optionally, in conjunction with the tamper for better control.

The backstop can extend perpendicularly away from the base (e.g., adjacent to the back end) and can be adapted to stop the print media sheets as they are received by the tray. This backstop can further traverse the back end of the base between the first side and the second side such that it is perpendicular to the fixed side edge as well as perpendicular to the tamper and the repositioner. This backstop can further be movable (i.e., can comprise a third tamper). The resting position of this movable backstop (i.e., the position of the movable backstop when the print media sheets are being received by the tray) relative to the front end of the base can be adjusted depending upon the length of the sheets. The movable backstop can further be adapted to reposition the stack along the y-axis between the front and back ends of the base.

The embodiments of the system can also comprise one or more finishing mechanisms (e.g., folding and/or stapling functions of a booklet maker) that are operably connected to the compiling tray. The stack can be repositioned along the x-axis (e.g., by the repositioner) and, if necessary, the y-axis (e.g., by the movable backstop) in order to appropriately align the stack with these finishing mechanisms.

Embodiments of an associated method comprise providing a sheet compiling and fixed side edge registration system. Then, following a printing process, print media sheets are received individually (i.e., one at a time) into a compiling tray (e.g., into a vertical or horizontal compiling tray) of the system. Specifically, the sheets are received along a registration line on a first side of a base of the tray. They are further stopped at the back end of the base by a back edge that extends perpendicularly away from the base and traverses the back end between the first side and a second side.

The sheets are then tamped by a tamper against a fixed side edge. Specifically, a fixed side edge extends perpendicularly away from the base of the tray. The fixed side edge traverses the length of the base immediately outside and parallel to the registration line and is further perpendicular to the backstop. The fixed side edge can comprise at least one first section near the front end of the base and at least one second section near the back end of the base. The tamper is positioned on the opposite side of the tray (i.e., extends perpendicularly away from the base adjacent to the second side), is parallel to the fixed side edge and, thus, is also perpendicular to the backstop. Each time a print media sheet is received into the tray (e.g., each time a sheet is fed or dropped into a vertical compiling tray or fed or shot into a horizontal compiling tray) the tamper tamps the stack against the fixed side edge, thereby, squaring the stack.

Once the stack is complete (i.e., once a predetermined number of sheets have been received) and all sheets have been tamped against the fixed side edge, the stack can be repositioned along the x-axis of the base and, if necessary, along the y-axis of the base. Repositioning can be performed in order to appropriately align the stack with one or more finishing mechanisms (e.g., folding and/or stapling functions of a booklet maker).

These and other features are described in, or are apparent from, the following detailed description.

BRIEF DESCRIPTION OF THE DRAWINGS

Various exemplary embodiments of the systems and methods described in detail below, with reference to the attached drawing figures, in which.

DETAILED DESCRIPTION

While the following embodiments are described hereafter with reference to an edge registration system for incorporation into a printing machine between a printing mechanism and a finishing mechanism, it should be understood that the embodiments are not strictly limited to such a system. Rather, any device that allows compiling of individual sheets into a stack, edge registration of the sheets in the stack and repositioning of the stack such that edge registration is maintained is contemplated by this disclosure.

Many vertical compiling systems exist for dual stapled booklets. Most of these compiling systems have tamping systems that provide simultaneous horizontal tamping towards the center of the tray so as to properly register each sheet within a set (i.e., within a stack). However, due to limited space availability, the tampers are usually located too far from the vertical compiling edge (i.e., from the backstop) to provide adequate booklet registration. When sheets are tamped in a compiling tray in this manner, the locations of the tampers, as well as the length of contact between the tampers and the sheets, impacts the quality of registration. Specifically, the greater the contact length and the closer the tamper is to where the edge of the sheet is supported (i.e., the closer the tamper is to the backstop), the better the registration quality. However, due to the different components of the compiling tray (e.g., compiling flappers, backstop, etc.) and the finishing mechanisms (e.g., a booklet maker mechanism (including, crease rolls and a blade), a stapler module, etc.), the space available for the tampers is limited. This limited space leads to less than optimal registration quality. More particularly, FIGS. 8-10 illustrate an edge registration system 100 that is incorporated into a compiling tray of a printing machine between a printing mechanism and one or more finishing mechanisms (e.g., folding and/or stapling functions of a booklet maker).

Figure 8:
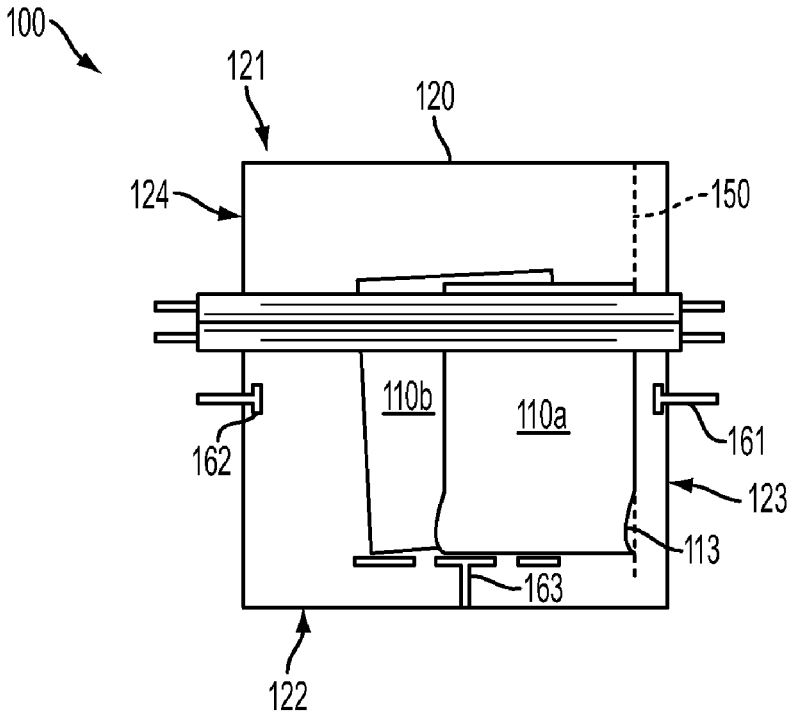
FIG. 8 is a schematic diagram illustrating an edge registration system for print media sheets.

Generally, referring to FIG. 8, each sheet 110 is printed, and individually fed into a compiling tray 120 along a side registration line 150 and stopped at or near the back end 122 of the tray 120 by a backstop 163. Referring to FIG. 9, each time a print media sheet (e.g., sheet 110*a*) is fed into the tray 120, it is tamped using dual side tampers 161-162 in conjunction with the backstop 163. The tampers 161-162 are typically moved by the same drive mechanism. This dual side tamping process squares and laterally displaces the sheet 110*a* along the x-axis to a desired location away from registration line 150 and further registers the side edges 111 of all the displaced sheets 110*a*, 110*b* that form a stack 115 at that desired location. Referring to FIG. 10, with vertical compiling trays the backstop 163 is often movable (i.e., is a rear tamper) that can be used to accommodate sheets of different lengths and can further be used to reposition the stack 115, once complete, along a y-axis between the front and back ends 121-122 of the tray 120.

Figure 2:
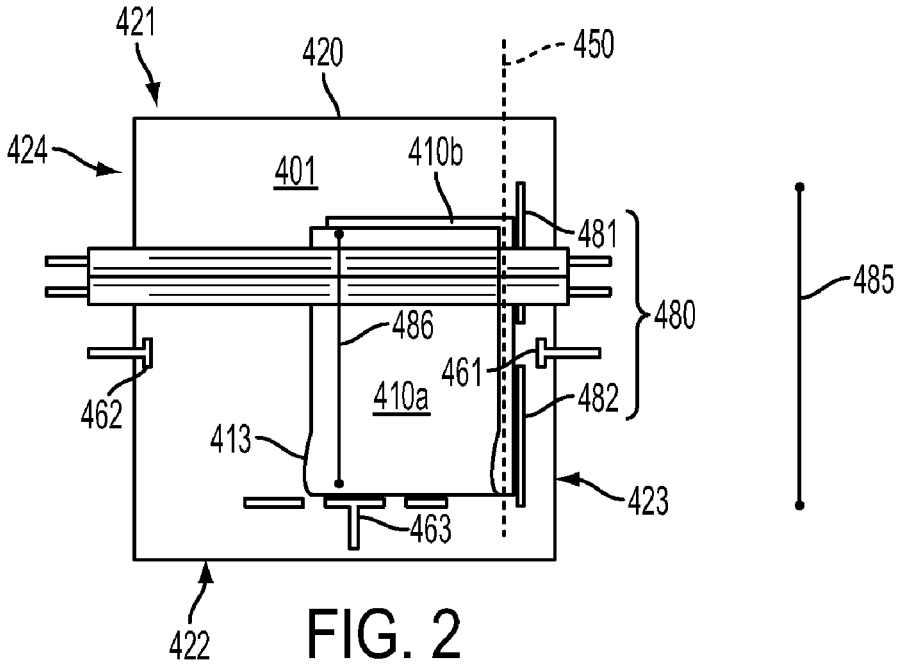
FIG. 2 is a schematic diagram illustrating a print media sheets received by the system of FIG. 1.

Repositioning the stack 115 along the x-axis 170 and, if necessary, along the y-axis 175 (see FIGS. 9 and 10 in combination) can be performed in order to align the stack 115 for processing with one or more finishing mechanisms 130 (e.g., a stapling and/or folding functions of a booklet maker). Thus, for example, the completed stack 115 can be moved to a given position along the y-axis in order to undergo a stapling process (e.g., as illustrated in U.S. Patent Application Publication No. 2004/0188911 of McNamara et al., published on Sep. 30, 2004, the complete disclosure of which is incorporated herein by reference). The completed stack 115 can also be moved to a given position along the y-axis in order to undergo a folding process (i.e., so that the center portion 116 of the stack 115 is aligned with the interface 132 of a blade and crease rolls 131 for a folding operation (e.g., as illustrated in FIG. 2 of U.S. Patent Application Publication No. 2006/0049574 of Matsumoto, published on Mar. 9, 2006, the complete disclosure of which is incorporated herein by reference)).

Figure 9:
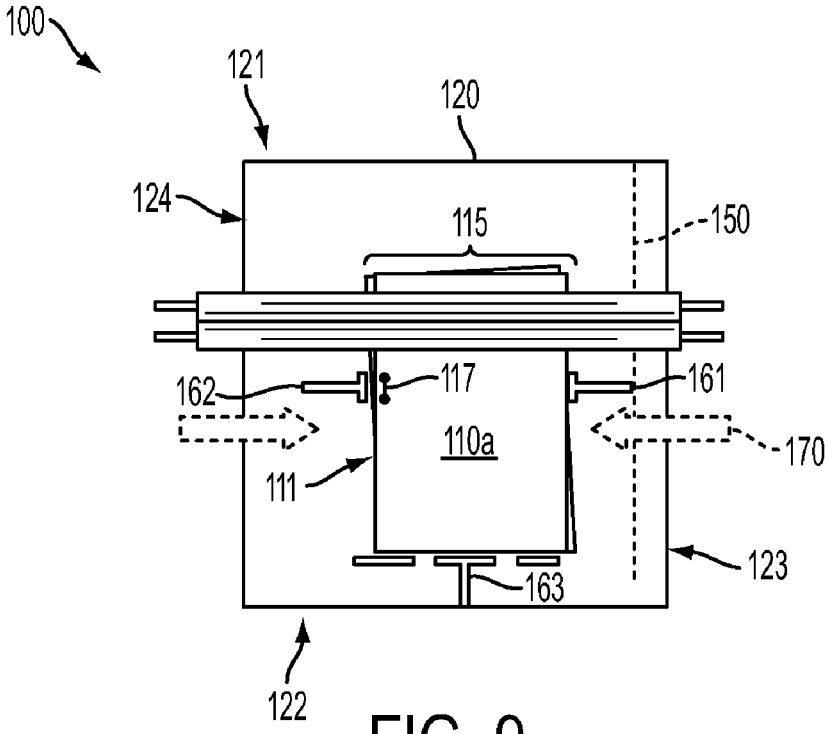
FIG. 9 is a schematic diagram illustrating a first tamping process by the system of FIG. 8.
Figure 10:
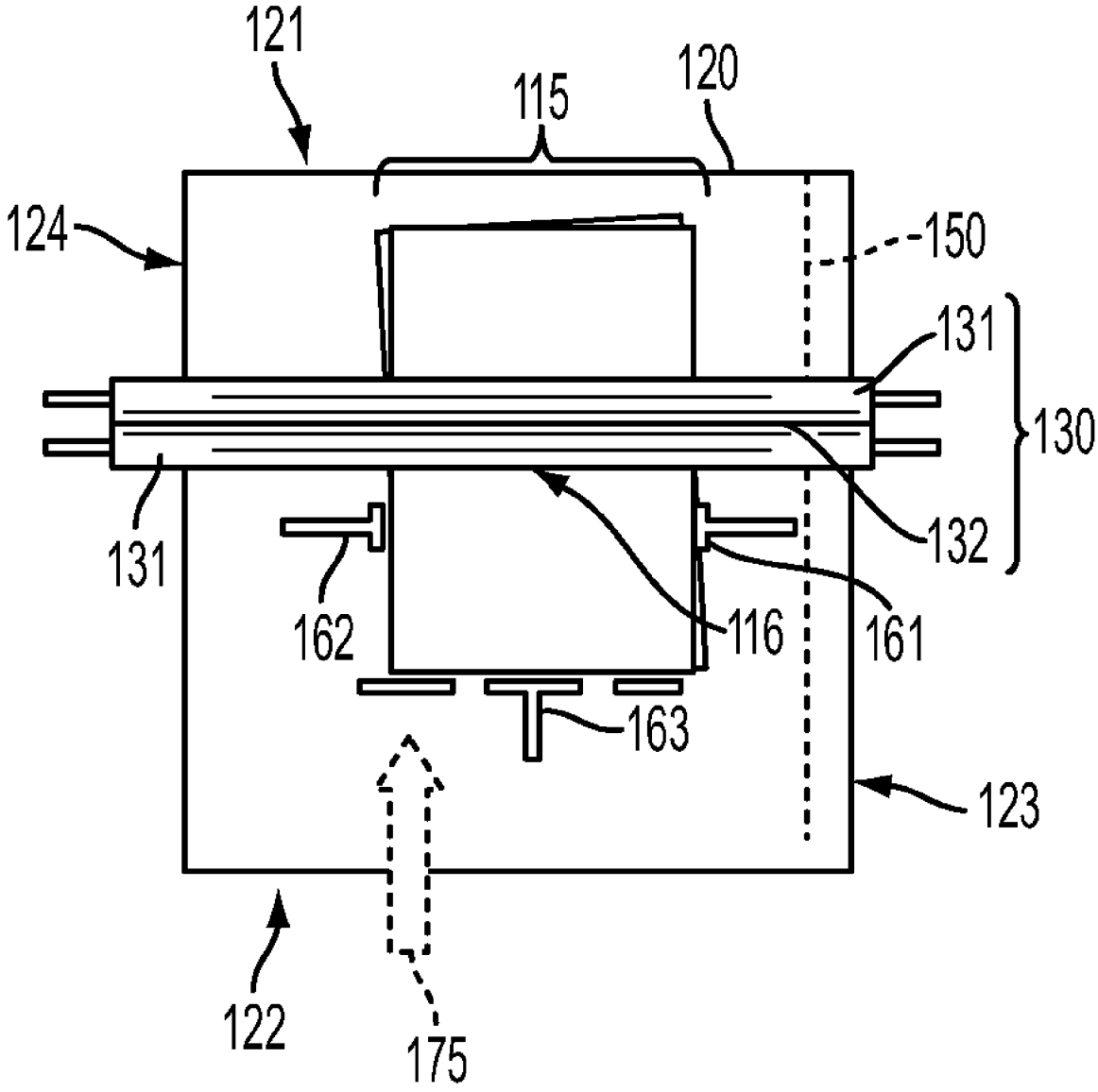
FIG. 10 is a schematic diagram illustrating a second tamping process by the system of FIG. 8.

When sheets 110 are tamped using a dual side tamping technique, as illustrated in FIG. 9, the locations of the tampers 161, 162 relative to the backstop 163, as well as the length 117 of contact between the tampers 161, 162 and the sheets 110, impacts the quality of registration. Specifically, the greater the contact length 117 and the closer the tampers 161, 162 are to the backstop 163 the better the registration quality, especially if dropping the sheets into a vertical tray 120 causes buckling near the backstop 163 (e.g., see buckling 113 of sheet 110*a* of FIG. 8). However, due to the different components of the compiling tray 120 (e.g., compiling flappers, backstop, etc.) and the finishing mechanisms 130, the space available for the tampers 161, 162 within the tray 120 is limited. This limited space may necessitate that the tampers 161, 162 be located at an undesirable fixed position within the tray 120 and may also necessitate that the tampers 161, 162 have a less than optimal contact length 117.

Additionally, as mentioned above, the position of the backstop 163 may vary in order to allow sheets of varying sizes to be compiled within the tray 120. For example, for longer sheets a movable backstop 163 may be positioned more towards the back end 122 of the tray 120 than for shorter sheets. Since the backstop 163 is farther away from the tampers 161, 162 for longer sheets than for shorter sheets, longer sheets are more susceptible to edge registration problems.

A mis-registration correction process can be incorporated into such systems 100. During this mis-registration correction process, after a sheet is dual side tamped, as illustrated in FIG. 9, so that it is laterally displaced along the x-axis 170 away from the side registration line 150 and incorporated into the stack 15, the movable backstop 163 is moved along the y-axis 175 towards the tampers 161, 162. Then, a second dual side tamping process is performed. Since the backstop 163 is closer to the tampers 161, 162 during this second dual side tamping process, any mis-registration remaining following the first dual side tamping process is corrected and the backstop 163 is then returned to its starting position to receive another sheet. However, this second dual side tamping process can reduce the life expectancy of the movable backstop 163 components as well as limited the compiling rate. Furthermore, because of the added time required to reposition the backstop 163 and perform the second dual side tamping process, this technique may only be incorporated into duplex printing jobs. That is, the rate at which sheets are received from simplex printing processes can be too fast to accommodate the additional time required for mis-registration correction.

FIGS. 1-7 illustrate exemplary embodiments of a fixed side edge registration system for print media sheets and, more particularly, for incorporation into a compiling tray of a printing machine between a printing mechanism and one or more finishing mechanisms (e.g., folding and/or stapling functions of a booklet maker). Also, disclosed are embodiments of an associated fixed side edge registration method. The embodiments employ a compiling tray with a fixed side edge, opposing side tampers and a backstop that is normal to the fixed side edge and side tampers. The fixed side edge covers the length of the compiling tray and is positioned outside a print media sheet path (e.g., a paper path). Print media sheets are fed into the compiling tray along the path and stopped by the backstop. A side tamper opposite the fixed side edge tamps every sheet against the fixed side edge for within stack registration. After the stack is completely compiled and registered, a repositioner (i.e., an opposing side tamper) extends from behind the fixed side edge and repositions the stack along the x-axis such that it remains "square" to the backstop. Both side tampers can be used jointly during laterally repositioning for better control. Additionally, the backstop can be movable (i.e., can comprise a rear tamper) that can be adjusted to accommodate sheets of different lengths and can be used to reposition the stack along the y-axis between the front and back of the tray, if necessary, for alignment with one or more finishing mechanisms (e.g., stapling and/or folding functions of a booklet maker).

Figure 1:
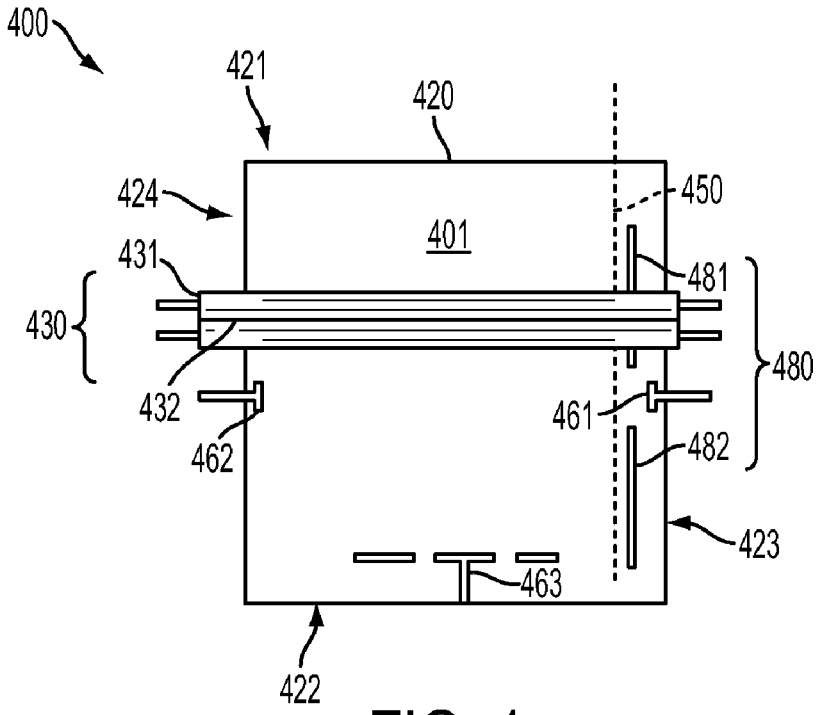
FIG. 1 is a schematic diagram illustrating an embodiment of an edge registration system with a fixed side edge.

More particularly, referring to FIG. 1, embodiments of one system 400 comprise a compiling tray 420 adapted to be incorporated into a printing machine. This tray 420 can be vertically or horizontally oriented depending upon the configuration of the printing machine. This tray 420 can comprise a base 401, a fixed side edge 480, a tamper 462 opposite and parallel to the fixed side edge 480, a repositioner 461 opposite and parallel to the tamper 462 and a backstop 463 that is normal to the fixed side edge 480 as well as to the tamper 462 and repositioner 461. The tamper 462, repositioner 461 and, optionally, the backstop 463 can each be electrically connected to and controlled via a control unit that is also incorporated into the printing machine.

Specifically, referring to FIG. 2, the base 401 of the tray 420 can have a front end 421, a back end 422, a first side 423 and a second side 424. The tray 420 can be adapted to receive print media sheets 410 (e.g., see sheets 410*a-b*) along a side registration line 450 (i.e., along a sheet pathway that extends predominantly through the first side 423 of the base 401).

For example, if the tray 420 is a vertical compiling tray, then the print media sheets 410 can be fed or dropped into the tray 420 by an entry nip at the front end 421 such that they are received into the tray 420 along the side registration line 481. Each sheet 410*a-b* can be stopped by the backstop 463 (i.e., when the leading edge of the sheet reaches the backstop). Alternatively, if the tray 420 is a horizontal compiling tray (i.e., stacker), the print media sheets 410 can be fed into the tray 420 (e.g., shot into the tray) by a compiling exit nip such that they are received into the tray 420 along the side registration line 481. Each sheet 410*a-b* will land on the tray, and as such horizontal trays are typically positioned at a slight angle, each sheet will slide backwards until the trailing edge of the sheet reaches the backstop 463.

Figure 3:
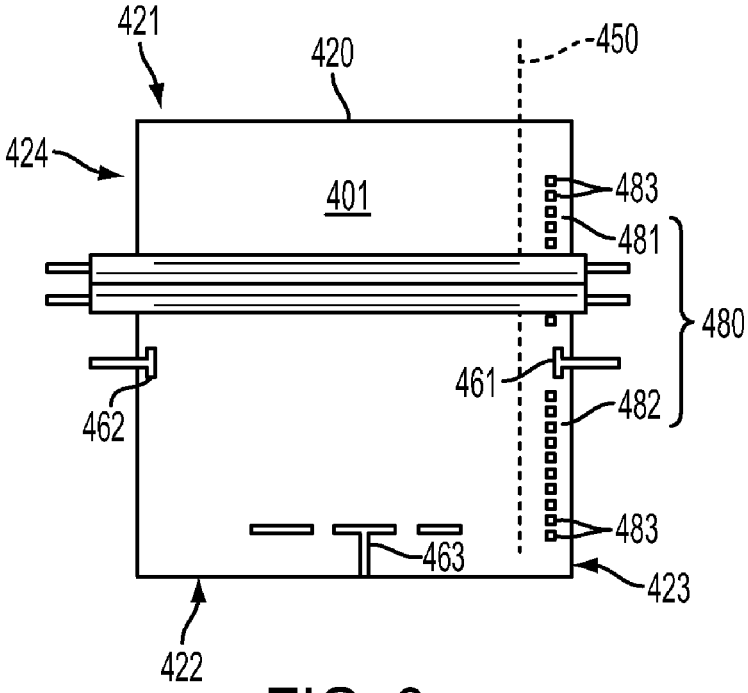
FIG. 3 is a schematic diagram illustrating an embodiment of the edge registration system with an alternative fixed side edge.

The fixed side edge 480 can extend perpendicularly away from the base 401 and can traverse (i.e., extend partially or completely across) the first side 423 of the base 401 immediately outside and parallel to the side registration line 450 from the front end 421 of the base 401 to the back end 422. Additionally, the length 485 of the fixed side edge 480 (i.e., a first length) can be approximately equal to or greater than the length 486 of the print media sheets 410 (i.e., a second length) that are received into the tray 420. The fixed side edge 480 can also be segmented such that it comprises at least one first section 481 near the front end 421 and at least one second section 482 near the back end 422. The first and second sections 481, 482 of the fixed side edge 480 can each comprise, for example, a single plate (as illustrated in FIG. 1) or a plurality of tabs 483 (as illustrated in FIG. 3).

The tabs and/or plates that comprise the first and second sections 481, 482 of the fixed side edge 480 can be formed using any suitable techniques. For example, the tabs/plates can be patterned, cut and folded inward from compiling tray components such as, the base, baffles, sidewalls, etc. Alternatively, the tabs and/or plates can be attached to the base, baffles and/or sidewalls.

Referring to FIG. 2, the tamper 462 can extend perpendicularly away from the base 401 of the tray 420 adjacent to the second side 424 and can be positioned opposite and parallel to the fixed side edge 480. After each sheet 410 is received into the tray 420 (i.e., fed, dropped, shot, etc., into the tray 420 by a feeding mechanism within the printing machine), the control unit initiates an initial tamping processing by the tamper 462. Specifically, the tamper 462 can be adapted to tamp each print media sheet 410 against the fixed side edge 480 immediately after it is fed into the tray 420 (i.e., to move the sheet 410 in a first direction 471 along the x-axis to the fixed side edge 480). This tamping process forms a stack 415 (i.e., a set) that is squared against the edge 480 and backstop 463 (see FIG. 4). Tamping can, for example, be timed off well-known entry sensing signals that are used is compiling systems to track compiling activities.

By repeating the initial tamping process each time a sheet 410 is fed into the tray 420, the edges 411 of the entire stack 415 are registered prior to aligning the stack 415 with a finishing mechanism 430 (e.g., a stapler or folder of a booklet maker). Furthermore, by tamping the sheets 410 against the fixed side edge 480, the system 400 provides improved within set (i.e., within stack) registration quality. That is, because the fixed side edge 480 covers the entire length of the print media sheets 410 (except for the opening or gap through which the repositioner 461 passes (see FIG. 1) and, depending upon the embodiment, except for the gaps between tabs (see FIG. 3)) and because the sheets are only tamped a short distance (i.e., the distance between the side registration line 450 and the fixed side edge 480) to achieve registration, the system 400 provides greater support for squaring the sheets 410 and eliminating buckles that form as sheets are fed into the tray against the backstop 463 (see buckles 413 of sheet 410*a* of FIG. 2).

The number of sheets 410 required to form a complete stack 415 (i.e., a complete set) can be predetermined and programmed into the control unit by a user. Once the predetermined number of sheets 410 is reached in the stack 415, as recognized, for example, by a sensor or counter, a signal is sent to the control unit, which then initiates a lateral repositioning process by the repositioner 461 (i.e., a second tamper) to reposition the stack along the x-axis towards the second side 424 of the base 401.

Figure 5:
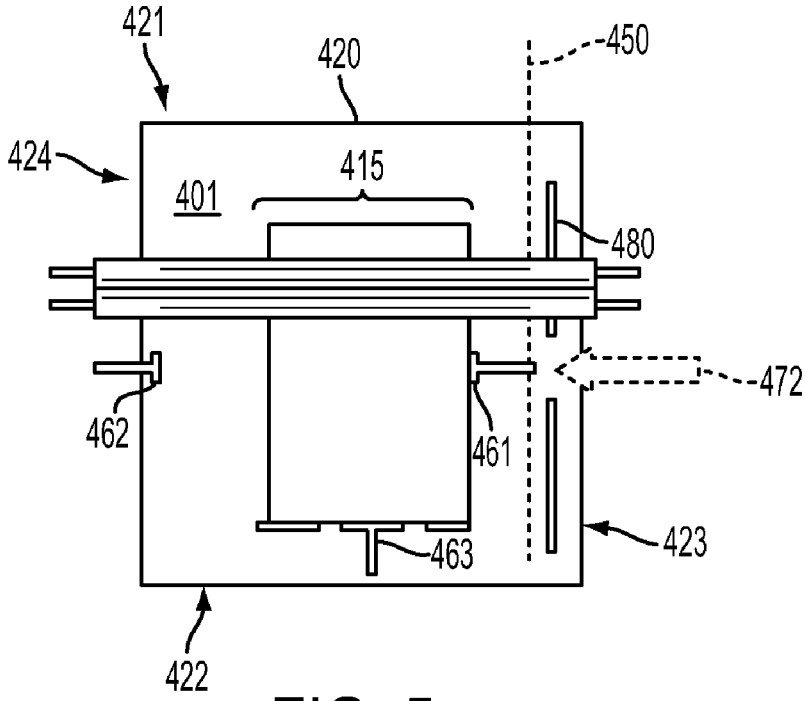
FIG. 5 is a schematic diagram illustrating a first repositioning process by the system embodiments.
Figure 6:
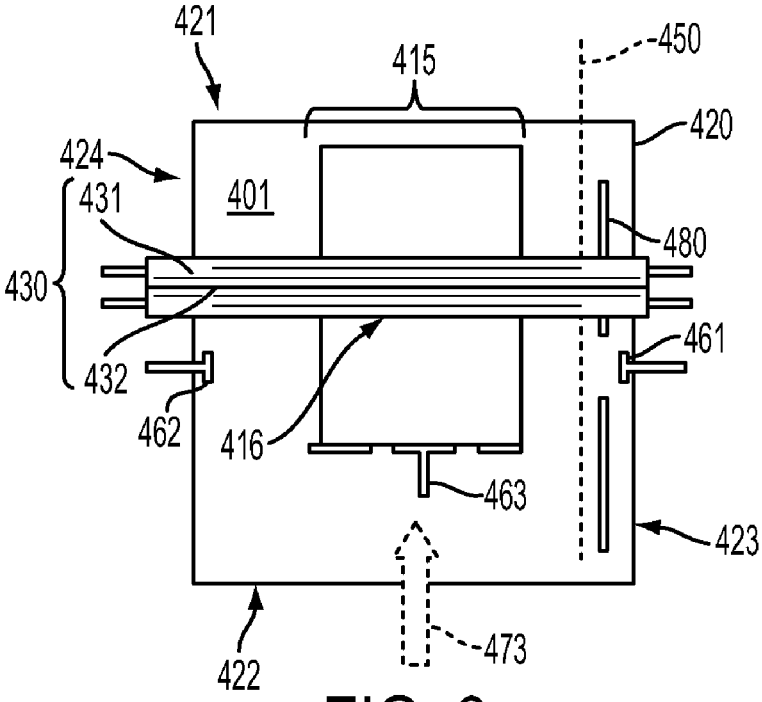
FIG. 6 is a schematic diagram illustrating a second repositioning process by the system embodiments.

Referring to FIG. 5, the repositioner 461 can extend perpendicularly from the base 401 of the tray 420 adjacent to the first side 423 and can be positioned between the first section 481 and the second section 482 of the fixed side edge directly opposite and parallel to the tamper 462. When in a standby position, the repositioner 461 can be located just behind the fixed side edge 480 so as not to interfere with the initial tamping process. In other words, during the tamping process the repositioner 461 is positioned further from the sheets than the fixed side edge 480 so as not to block the sheets from being tamped square against the fixed side edge 480. Additionally, the repositioner 461 can be adapted to extend between the first and second sections 481-482 of the fixed side edge 480, when not in standby, in order to laterally reposition the completed stack 415 a predetermined distance away from the fixed side edge 480 in a second direction 472 along the x-axis of the base 401 (i.e., towards the second side 424). Specifically, the repositioner 461 can be adapted to work alone (i.e., to perform a single side tamping process) or, optionally, in conjunction with the tamper 462, in order to laterally reposition the stack 415 in the second direction 472. Those skilled in the art will recognize that allowing the tamper 462 to work in conjunction with the repositioner 461 (i.e., to perform a dual side tamping process) will ensure that the edge 411 registration of the stack 415, which is achieved during initial tamping, will be maintained as the stack 415 is laterally repositioned.

The backstop 463 can, optionally, be movable (i.e., can be formed as a third tamper). The resting position of such a moveable backstop 463 can be adjusted to accommodate sheets 410 of differing lengths. Additionally, referring to FIG. 6, if the backstop 463 is movable, then once the stack 415 is laterally repositioned in the second direction 472, the control unit can initiate repositioning by the moveable backstop 463 of the stack 415 along the y-axis (i.e., between the front and back ends) so as to appropriately align the stack 415 with one or more finishing mechanisms 430. Because the sheets 410 are only tamped a short distance (i.e., the distance between the side registration line 450 and the fixed side edge 480) to achieve registration and because the backstop 463 is only moved during alignment of the stack 415 with the finishing mechanism 430, the system 400 is capable of handling faster jobs (i.e., simplex) and improving productivity.

Specifically, the movable backstop 463 (i.e., third tamper or movable back edge) can extend perpendicularly away from the base 401 and can further traverse (i.e., extend partially across) the base 401 between the first side 423 and the second side 424 (e.g., adjacent to the back end 422) such that it is also perpendicular to the fixed side edge 480, the tamper 462 and the repositioner 461. This movable backstop 463 can be adapted to stop the print media sheets 410*a-b* as they are received into the tray 420 (e.g., as they are fed or dropped into a vertical compiling tray or fed or shot into a horizontal compiling tray). The resting position of the moveable backstop 463 can be varied depending upon the length of the sheets 410 and pre-programmed into the control unit. For example, for longer sheets 410, the control unit can be programmed so that the resting position of the movable back stop 463 is closer to the back end 422 of the base 401. For shorter sheets, the control unit can be programmed so that the resting position of the movable back stop 463 is closer to the center of the base. This movable back stop 463 can further be adapted to reposition the stack 415 along the y-axis of the base 401 (i.e., to move the stack 415 a predetermined distance in a third direction 473 towards the front end 421 of the base 401 and/or a predetermined distance in a fourth direction towards the back end 422 of the base 401), if necessary, in order to align the stack 415 with one or more finishing mechanisms 430.

For example, a booklet maker mechanism incorporated into the system may comprise two separate finishing mechanisms 430 (e.g., a stapler and a folder) that are operably connected to the compiling tray 420. The completed stack 415 can be moved by the back edge 463 to a given position along the y-axis in order to undergo a stapling process (e.g., as illustrated in U.S. Patent Application Publication No. 2004/0188911 of McNamara et al., published on Sep. 30, 2004, the complete disclosure of which is incorporated herein by reference). The completed stack 415 can then be moved to a different position along the y-axis in order to undergo a folding process (i.e., so that the center portion 416 of the stack 415 is aligned with the interface 432 of a blade and crease rolls 431 for a folding operation (e.g., as illustrated in FIG. 2 of U.S. Patent Application Publication No. 2006/0049574 of Matsumoto, published on Mar. 9, 2006, the complete disclosure of which is incorporated herein by reference)).

The tamper 462, repositioner 461 and, optionally, the backstop 463 can each comprise a separate tamping/repositioning mechanism, each having an independent driver. The mechanisms 461, 462, 463 may be the same or different types and can, for example, comprise one of the tamping/repositioning mechanisms that are disclosed in the following documents (the complete disclosures of which are incorporated herein by reference) or a combination thereof: U.S. Patent Application Publication No. 2005/0263958 of Knierim et al., published on Dec. 1, 2005; U.S. Pat. No. 6,533,268 of Williams et al., issued on Mar. 18, 2003; U.S. Pat. No. 6,003,862 of Russel et al., issued on Dec. 21, 1999; U.S. Pat. No. 5,639,078 of Mandel et al., issued on Jun. 17, 1997; U.S. Pat. No. 5,473,420 of Rizzolo et al., issued on Dec. 5, 1995; U.S. Pat. No. 5,014,977 of Moore et al., issued on May 14, 1991; U.S. Pat. No. 4,844,440 of Gray, issued on Jul. 4, 1989; and U.S. Pat. No. 4,147,342 of Naramore issued on Apr. 3, 1979.

Figure 7:
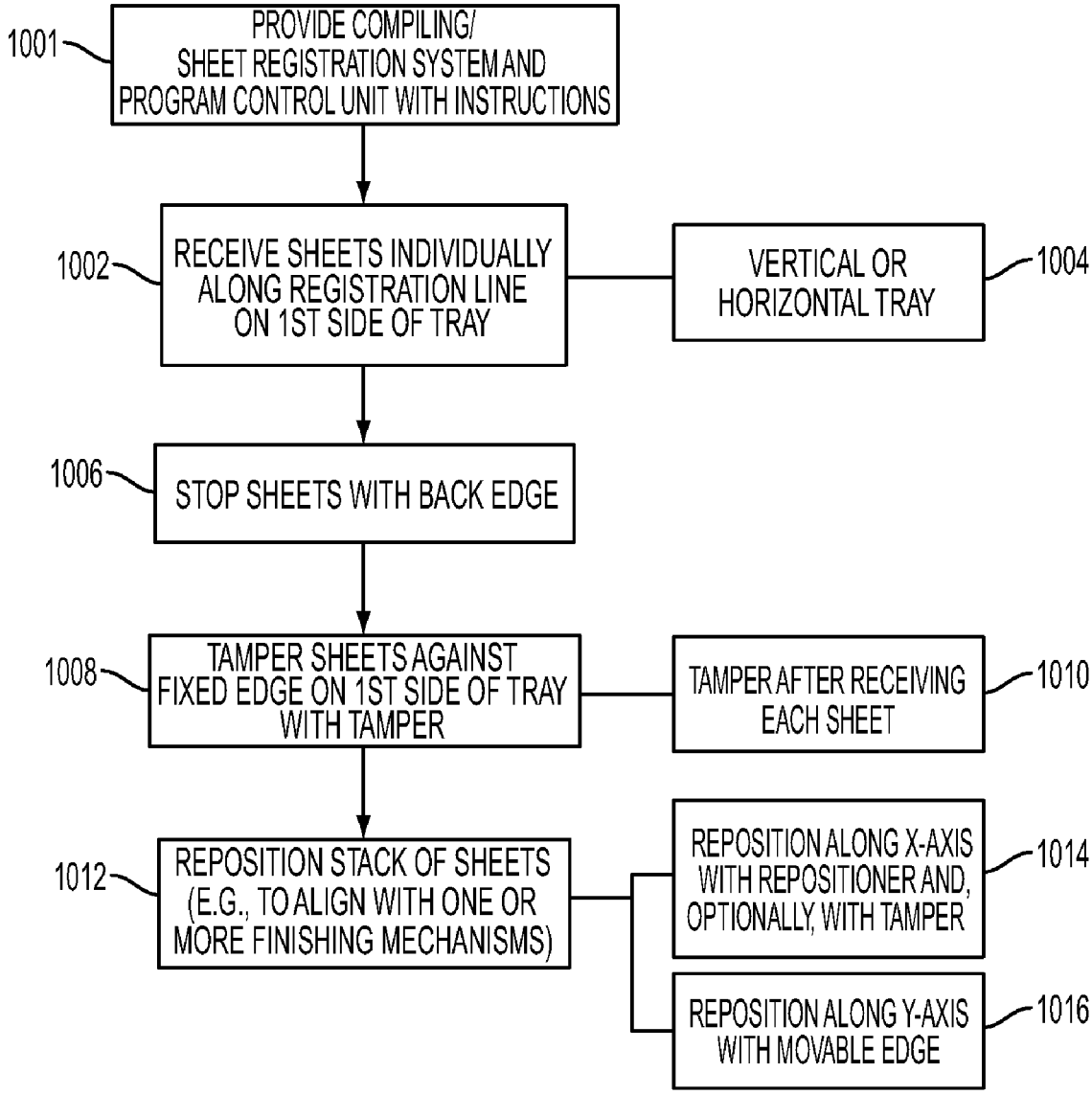
FIG. 7 is a flow diagram illustrating embodiments of an edge registration method for print media sheets.

Referring to FIG. 7, embodiments of an associated method comprise providing a sheet compiling and edge registration system 400 (1001, see FIGS. 1 and 3) and programming a control unit that is electrically connected to the compiling and edge registration system 400 with instructions for compiling and registering a set 415 of print media sheets 410 that contain a predetermined number of printed sheets and for aligning the set 415 with a finishing mechanism 430.

Then, as the print media sheets 410 are printed by a printing mechanism, they are received individually into a compiling tray 420 (e.g., into a vertical or horizontal compiling tray) of the system 400 (1002-1004, see FIG. 2). Specifically, the sheets 410 are received individually (i.e., one at a time) in order to compile a stack 415 of print media sheets within the tray 420. The sheets 410 are received along a side registration line 450 (e.g., of a paper path) on a first side 423 of the base 401. They are further stopped by a movable edge 463 that extends perpendicularly away from the base 401 and traverses (e.g., extends partially across) the base 401 between the first side 423 and a second side 424 (1006).

For example, if the tray 420 comprises a vertical tray, then the print media sheets 410 can be fed or dropped into the tray 420 by an entry nip at the front end 421 such that they are received into the tray 420 along the side registration line 450. Each sheet 410*a-b* can be stopped (e.g., at the back end 422) by the backstop 463 (i.e., when the leading edge of the sheet reaches the backstop). Alternatively, if the tray 420 comprises a horizontal tray (i.e., stacker), the print media sheets 410 can be fed into the tray 420 (e.g., shot into the tray) by a compiling exit nip such that they are received into the tray 420 along the side registration line 450. Each sheet 410*a-b* will land on the tray, and as such trays are typically slightly angled, each sheet will slide backwards until the trailing edge of the sheet reaches the backstop 463.

The exact location of the backstop 463 along the y-axis of the base 401 may be varied depending upon the length of the sheets 410*a-b*. For example, the longer the sheets 410, the farther the edge 463 will be from the front end 421 of the base 401.

Figure 4:
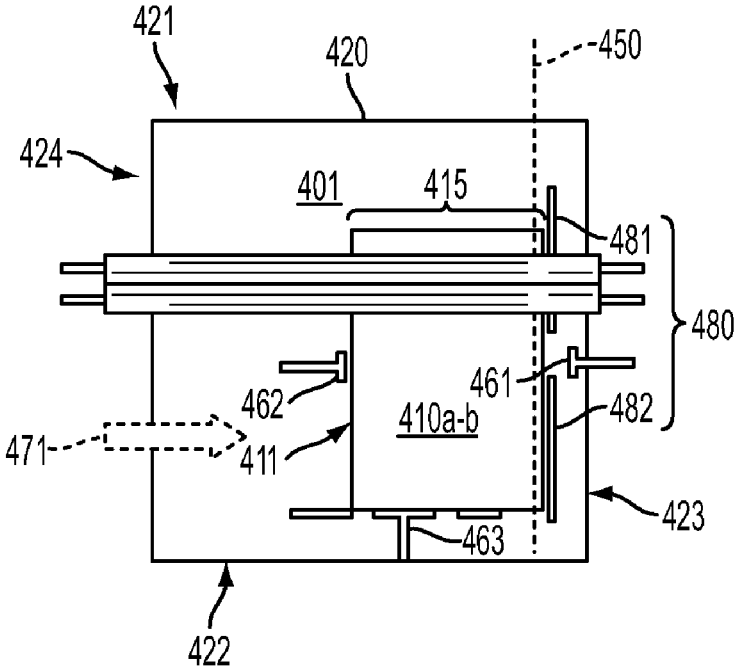
FIG. 4 is a schematic diagram illustrating a tamping process by the system embodiments.

The sheets 410 are then tamped by a side tamper 462 in a first direction 471 along the x-axis against a fixed side edge 480 (1008, see FIG. 4). Specifically, a fixed side edge 480 extends perpendicularly away from the base 401 of the tray 420. The fixed side edge 480 traverses the length of the base 401 (i.e., extends partially or completely across the length of the base 401 from the front end 421 to the back end 422) immediately outside and parallel to the registration line 450 and is further perpendicular to the backstop 463. The fixed side edge 480 can comprise at least one first section 481 near the front end 421 of the base 401 and at least one second section 482 near the back end 422 of the base 401. The tamper 462 is positioned on the opposite side of the tray 420 (i.e., on the second side 424 of the tray 420, is parallel to the fixed side edge 480 and, thus, is also perpendicular to the backstop 463. Each time a print media sheet 410 is received into the tray 420 at process 1002 (e.g., each time a sheet is fed or dropped into a vertical compiling tray or fed or shot into a horizontal compiling tray) the tamper 462 tamps the stack 415 against the fixed side edge 480 at process 1008, thereby, squaring the stack 415.

Once the stack 415 is complete (i.e., once the predetermined number of sheets 410 has been received and all sheets 410 have been tamped against the fixed side edge 480), the stack 415 can be repositioned in order to appropriately align the stack 415 with one or more finishing mechanisms 430 (e.g., stapling and/or folding functions of a booklet maker) (1012). Specifically, the stack 415 can be repositioned in a second direction 472 along the x-axis (i.e., from the first side 423 of the base 401 towards the second side 424 of the base 401) by a repositioner 462 (i.e., a second tamper) (1014, see FIG. 5). This repositioner 461 is located opposite and parallel to the tamper 462 (e.g., between first and second sections 481-482 of the fixed side edge) and thus, is also perpendicular to the backstop 463. The repositioner 461 can work alone. Alternatively, the respositioner 461 can work in conjunction with the tamper 462 to better ensure that the stack 415 remains square during the lateral repositioning process. The stack 415 can also be repositioned along the y-axis of the base 401 (i.e., moved a predetermined distance in a third direction 473 towards the front end 421 of the base 401 and/or a predetermined distance in a fourth direction towards the back end 422 of the base 401) in order to align the stack 415 with the one or more finishing mechanisms 430 (1016, see FIG. 6).

Therefore, disclosed above are embodiments of an edge registration system and an associated edge registration method. The embodiments employ a compiling tray with a fixed side edge that covers the length of the compiling tray and is positioned outside a side registration line. A back edge that is perpendicular to the fixed side edge stops each sheet at a given position as it is fed into the tray. A tamper opposite the fixed side edge tamps each sheet that is fed into the tray against the fixed side edge. After a stack of sheets is completely compiled and registered, a repositioner opposite the tamper laterally repositions the entire stack. The tamper and repositioner can be used jointly during laterally repositioning for better control. The back edge then tamps the stack towards the front of the tray for alignment with a finishing mechanism. Because the fixed side edge covers the entire paper length and because the paper is only tamped a short distance to achieve registration, the system provides greater support for squaring the sheets and eliminating buckles that form as sheets are fed into the tray against the back edge. Additionally, because the paper is only tamped a short distance to achieve registration, and because the back edge is only moved during alignment of the stack with a finishing mechanism, the system is capable of handling faster jobs (i.e., simplex) and improving productivity.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus comprising:

a tray comprising a base, wherein said base comprises a front end, a back end, a first side and a second side, and wherein said tray is adapted to receive print media sheets;

a fixed side edge that is at least approximately equal in length to said print media sheets, that extends perpendicularly from said base and that traverses said base on said first side, wherein said fixed side edge is segmented and comprises: at least one first section near said front end; and at least one second section near said back end, in line with said at least one first section, and separated from said at least one first section by a gap;

a tamper that extends perpendicularly from said base adjacent to said second side and that is positioned to tamp said print media sheets against said at least one first section and said at least one second section of said fixed side edge such that a stack of said print media sheets is squared against said fixed side edge; and a repositioner that extends perpendicularly from said based adjacent to said first side and that is positioned to extend through said gap between said at least one first section and said at least one second section and to reposition said stack of said print media sheets towards said second side.

2. The apparatus according to claim 1, further comprising a backstop that extends perpendicularly from said base, that is perpendicular to said fixed side edge, and that is positioned to stop said print media sheets as said print media sheets are received into said tray.

3. The apparatus according to claim 2, wherein said backstop is further movable and positioned to reposition said stack between said front end and said back end, wherein movement of said backstop to reposition said stack between said front end and said back end is automatically controlled by a control unit.

4. The apparatus according to claim 1, wherein said first section and said second section of said fixed side edge each comprise a plurality of tabs.

5. The apparatus according to claim 1, wherein said first section and said second section of said fixed side edge each comprise a single plate.

6. The apparatus according to claim 1, wherein said print media sheets are received into said tray along a registration line on said first side and wherein said fixed side edge is positioned outside said registration line.

7. The apparatus according to claim 1, wherein a first length of said fixed side edge is approximately equal to or greater than a second length of said print media sheets.

8. An apparatus comprising:

a vertical tray comprising a base, wherein said base comprises a front end, a back end, a first side and a second side, and wherein said tray is adapted to receive said print media sheets through said front end;

a fixed side edge that is at least approximately equal in length to said print media sheets, that extends perpendicularly from said base and that traverses said base on said first side, wherein said fixed side edge is segmented and comprises: at least one first section near said front end; and at least one second section near said back end, in line with said at least one first section, and separated from said at least one first section by a gap;

a tamper that extends perpendicularly from said base adjacent to said second side and that is positioned to tamp said print media sheets against said at least one first section and said at least one second section of said fixed side edge such that a stack of said print media sheets is squared against said fixed side edge;

a repositioner that extends perpendicularly from said base adjacent to said first side and that is positioned to extend through said gap between said at least one first section and said at least one second section and to reposition said stack of said print media sheets towards said second side; and a movable backstop that extends perpendicularly from said base, that is perpendicular to said fixed side edge and that is adapted to stop said print media sheets as said print media sheets are received and to reposition said stack between said front end and said back end, wherein movement of said backstop to reposition said stack between said front end and said back end is automatically controlled by a control unit.

9. The apparatus according to claim 8, further comprising a finishing mechanism operably connected to said tray, wherein said movable backstop and said repositioner are positioned to reposition said stack such that said stack is appropriately aligned with said finishing mechanism.

10. The apparatus according to claim 8, wherein said first section and said second section of said fixed side edge each comprise a plurality of tabs.

11. The apparatus according to claim 8, wherein said first section and said second section of said fixed side edge each comprise a single plate.

12. The apparatus according to claim 8, wherein said print media sheets are received by said tray along a registration line on said first side and wherein said fixed side edge is positioned outside and parallel to said registration line.

13. The apparatus according to claim 8, wherein a first length of said fixed side edge is approximately equal to or greater than a second length of said print media sheets.

14. A method comprising:

receiving print media sheets along a registration line on a first side of a base of a compiling tray in order to compile a stack of said print media sheets;

tamping said stack against a fixed side edge that extends perpendicularly from said base and is positioned on said first side outside and parallel to said registration line, wherein said fixed side edge is approximately equal in length to said print media sheets and wherein said fixed side edge is segmented and comprises: at least one first section near said front end; and at least one second section near said back end, in line with said at least one first section, and separated from said at least one first section by a gap such that during said tamping said stack is squared against said fixed side edge; and after said tamping, repositioning said stack towards a second side of said base, said repositioning comprising extending a repositioner though said gap between said at least one first section and said at least one second section so as to push said stack towards said second side.

15. The method of claim 14, further comprising, during said receiving, stopping said print media sheets with a movable backstop that is perpendicular to said fixed side edge.

16. The method of claim 15, further comprising, after said tamping, repositioning said stack between a front end of said base and a back end of said base with said movable backstop, as automatically controlled by a control unit.

17. The method of claim 14, wherein said tamping comprises tamping said stack against said fixed side edge each time a sheet is received.

18. A method comprising:

receiving print media sheets along a registration line on a first side of a base of a vertical compiling tray in order to compile a stack of said print media sheets;

tamping said stack against a fixed side edge that extends perpendicularly from said base and is positioned on said first side outside and parallel to said registration line, wherein said fixed side edge is approximately equal in length to said print media sheets and wherein said fixed side edge is segmented and comprises: at least one first section near said front end; and at least one second section near said back end, in line with said at least one first section, and separated from said at least one first section by a gap such that during said tamping said stack is squared against said fixed side edge; and after said tamping, repositioning said stack towards a second side of said base, said repositioning comprising extending a repositioner though said gap between said at least one first section and said at least one second section so as to push said stack towards said second side.

19. The method of claim 18, further comprising, during said receiving, stopping said print media sheets with a movable backstop that is perpendicular to said fixed side edge.

20. The method of claim 19, further comprising repositioning said stack between a front end of said base and a back end of said base with said movable backstop, as automatically controlled by a control unit, wherein said repositioning processes comprise aligning said stack with a finishing mechanism.

* * * * *